US005471774A

United States Patent [19]

Hoyt et al.

[11] Patent Number: 5,471,774

[45] Date of Patent: Dec. 5, 1995

[54] LOWERABLE CHANGEABLE MESSAGE AND MAINTENANCE SIGN

[76] Inventors: Wilber S. Hoyt, 406 Beverly Dr., Lafayette, La. 70503; James G. Close, 16 Big Oak Cir., Malakoff, Tex. 75148

[21] Appl. No.: 36,957

[22] Filed: Mar. 23, 1993

Related U.S. Application Data

[63] Continuation-in-part of Ser. No. 956,367, Oct. 5, 1992, abandoned.

[51] Int. Cl.[6] ..... G09F 7/00

[52] U.S. Cl. ..... 40/601; 40/617

[58] Field of Search ..... 40/601, 602, 617, 40/624; 187/407

[56] References Cited

U.S. PATENT DOCUMENTS

| | | | |
|---|---|---|---|
| 522,980 | 7/1894 | Fleming | 40/601 |
| 822,538 | 6/1906 | Morgan | 187/407 X |
| 1,772,229 | 8/1930 | Slate | 187/407 X |
| 2,979,842 | 4/1961 | De Ridder | 40/156 |
| 3,579,880 | 5/1971 | Murphy | 40/601 X |
| 4,627,766 | 12/1986 | Mcrquet | 40/617 X |

FOREIGN PATENT DOCUMENTS

| | | | |
|---|---|---|---|
| 322302 | 6/1989 | European Pat. Off. | 40/601 |
| 647304 | 10/1962 | Italy | 40/601 |

*Primary Examiner*—Brian K. Green
*Assistant Examiner*—Cassandra Davis
*Attorney, Agent, or Firm*—Dowell & Dowell

[57] ABSTRACT

A wind sail sign system for mounting to existing sign structural columns and a method of raising or lowering a wind sail sign over and around other signs comprising a winch assembly and guide elements. The wind sail sign of the instant invention is constructed of lightweight materials, quick-change frame assemblies and laminated panels.

17 Claims, 9 Drawing Sheets

LOWERABLE CHANGEABLE MESSAGE AND MAINTENANCE SIGN

This is a continuation-in-part application of application Ser. No. 07/956,367, filed Oct. 5, 1992, now abandoned.

BACKGROUND OF THE INVENTION

1. Field of the Invention

This invention relates to signs and particularly to highway display signs of the type commonly employed along the roadways of interstate highways or shopping malls. This invention is even more related to wind sail-type signs that are hinged at the top to allow some degree of motion as a result of wind force.

2. General Background

Wind sail signs have been used for many years to reduce the resistance loads created by strong winds on the support columns. The movement of these types of signs have proven effective in attracting the attention of those who pass. Signs of this type usually are permanently mounted, not easily accessible, inherently dangerous, and costly to change any type of display. To overcome some of these problems, other inventors such as A. L. BAUERS ET AL U.S. Pat. No. 2,522,157 devised a method of changing or lowering the poster panels from a sign frame to reduce sign damage from high winds. GEORGE R. ASACHIKA, U.S. Pat. No. 2,591,494, also devised a sign structure having a channel in which rollers located on each side of the sign are guided to raise or lower the sign frame during high wind conditions.

The teachings of Bauers and Asachika do not anticipate the possibility of raising and lowering a wind sail sign without the use of a guide channel or the possibility of erecting such signs utilizing existing sign structures. The prior art does not address a means for raising or lowering a sign while maneuvering over/around an obstruction.

SUMMARY OF THE PRESENT INVENTION

The wind sail sign system of the present invention consists of a new and novel approach to improving existing roadside signs and free standing sign structures using the wind sail sign principles.

Existing roadside signs generally do not justify their cost due to over-design of the support structures because of their height and the lack of movement. Wind sail signs are designed to "spill" the wind thereby reducing wind load on the support structure and, as an added benefit, provide motion that is eye-catching.

Most roadside signs are of the fixed panel type, meaning the whole panel must be replaced, when a change in the message is required, often an expensive and tedious process. Even when signs have changeable message capability, the process of changing is a hazardous operation, requiring personnel to work from high ladders. Where sail signs are employed, the danger to personnel is multiplied due to wind movement of the sign.

Now that gasoline stations often sell other items such as food to lure travelers of the road, advertising such items is becoming more competitive. Messages describing such items need to be changed frequently and inexpensively to keep pace with the changing market. Therefore, a simple, attractive, inexpensive, and easily changeable sign system is needed.

It is an object of the present invention to improve sail sign systems, having a universal support structure, in a manner whereby they can be easily adapted to existing roadside sign structures.

It is another object of the present invention to provide a means for changing a wind sail sign message panel from ground level.

A further object of the present invention is to provide a means for raising and lowering a sign from over or between other signs.

Still a further object of the present invention is to provide an improved sail sign having quick-change, laminated paper panels.

DETAILED DESCRIPTION OF THE PREFERRED EMBODIMENT

Figure 1:
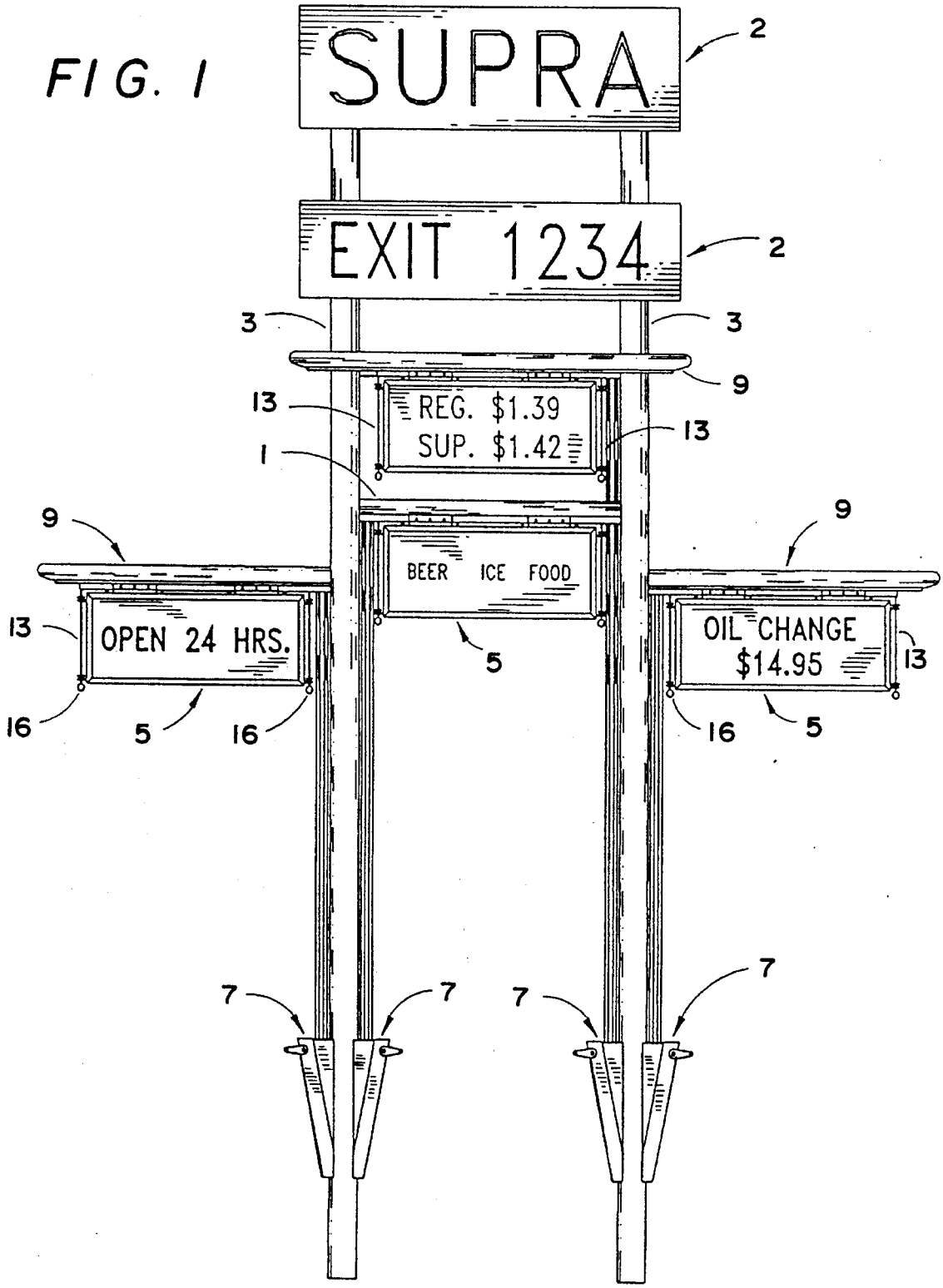
FIG. 1 is a front elevation view of a double column roadside sign structure with the adaptations of the present invention.
Figure 2:
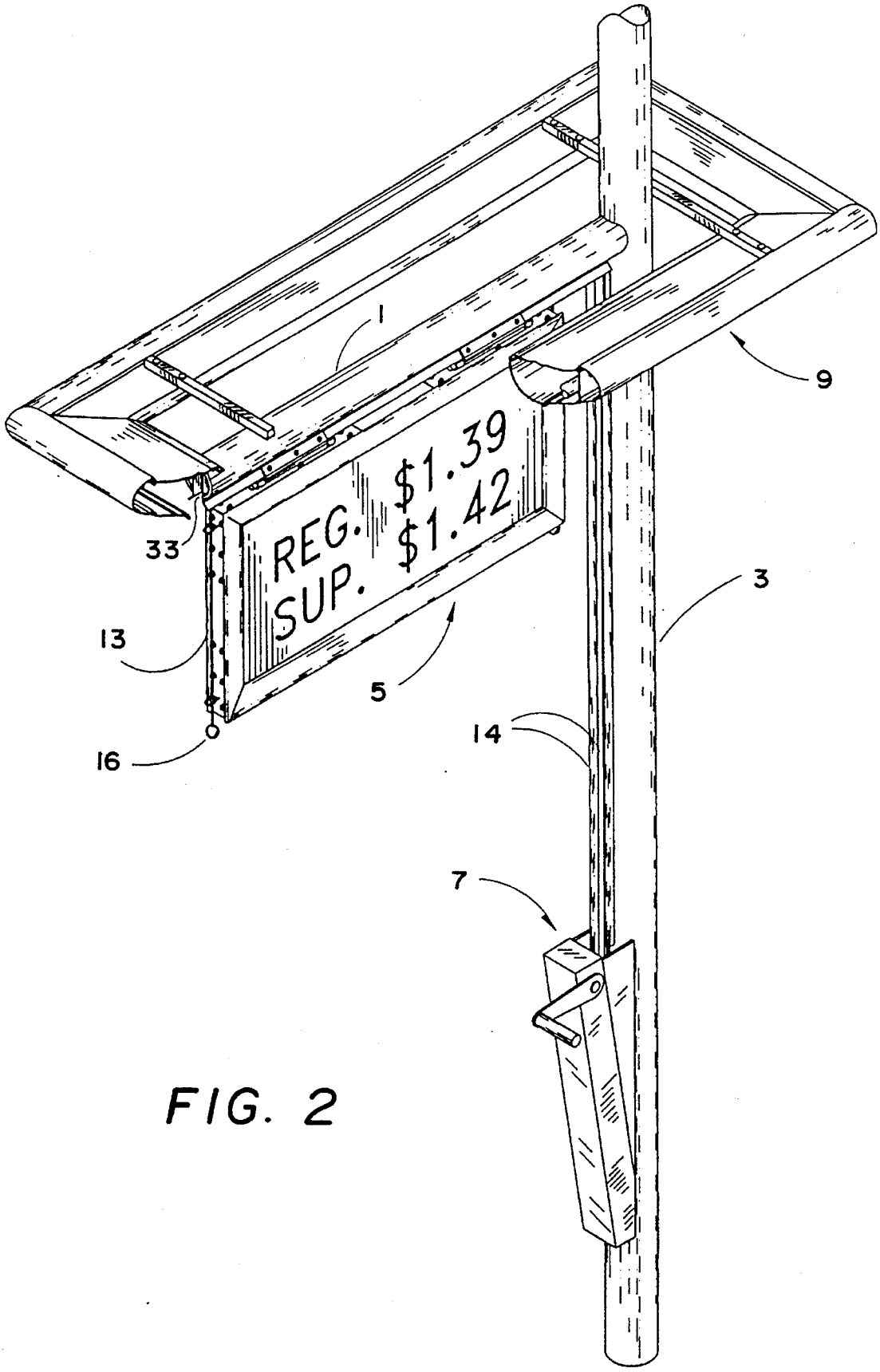
FIG. 2 is an isometric view of the sail sign system with a portion of the lighting fixture cut away for clarity.

Referring first to FIG. 1, the present invention can be easily mounted on almost any signs column. The wind sail sign 5 structural support 1 can be secured to sign columns 3 either cantilevered or supported between the columns of existing signs 2. Each wind sail sign 5 can be independently highlighted by installing lighting fixtures 9. The wind sail sign system as shown in FIG. 2 comprises the wind sail sign 5, its support structure 1, a lighting fixture assembly 9 is required, a winch assembly 7 with support cables 15 and control guide lines 13.

Figure 3:
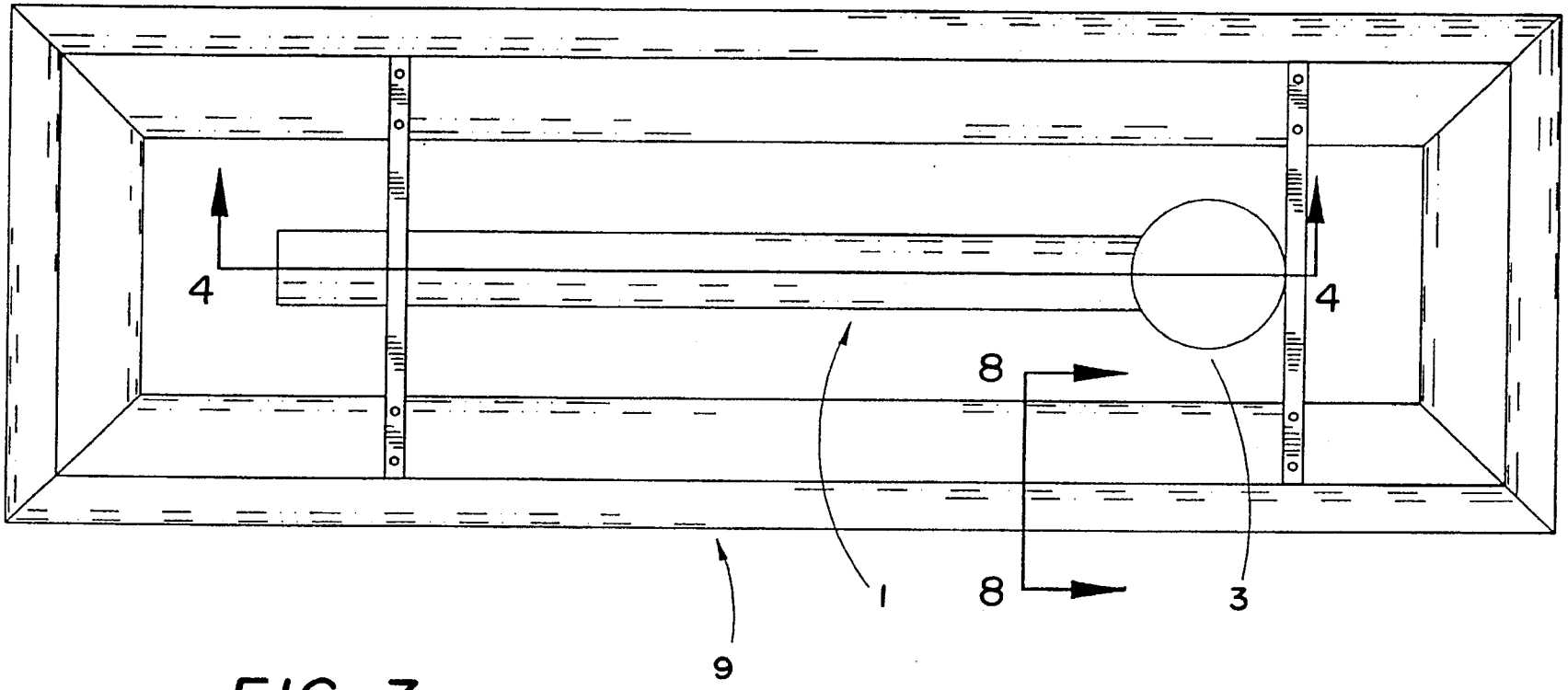
FIG. 3 is a plan view of the sail sign lighting fixture and support structure.

Referring now to FIG. 3, the wind sail sign support structure 1 is attached to a sign column 3 in a cantilevered manner. The lighting fixture assembly 9 is secured to the sign column 3 and wind sail sign structure 1 by cross braces.

Figure 4:
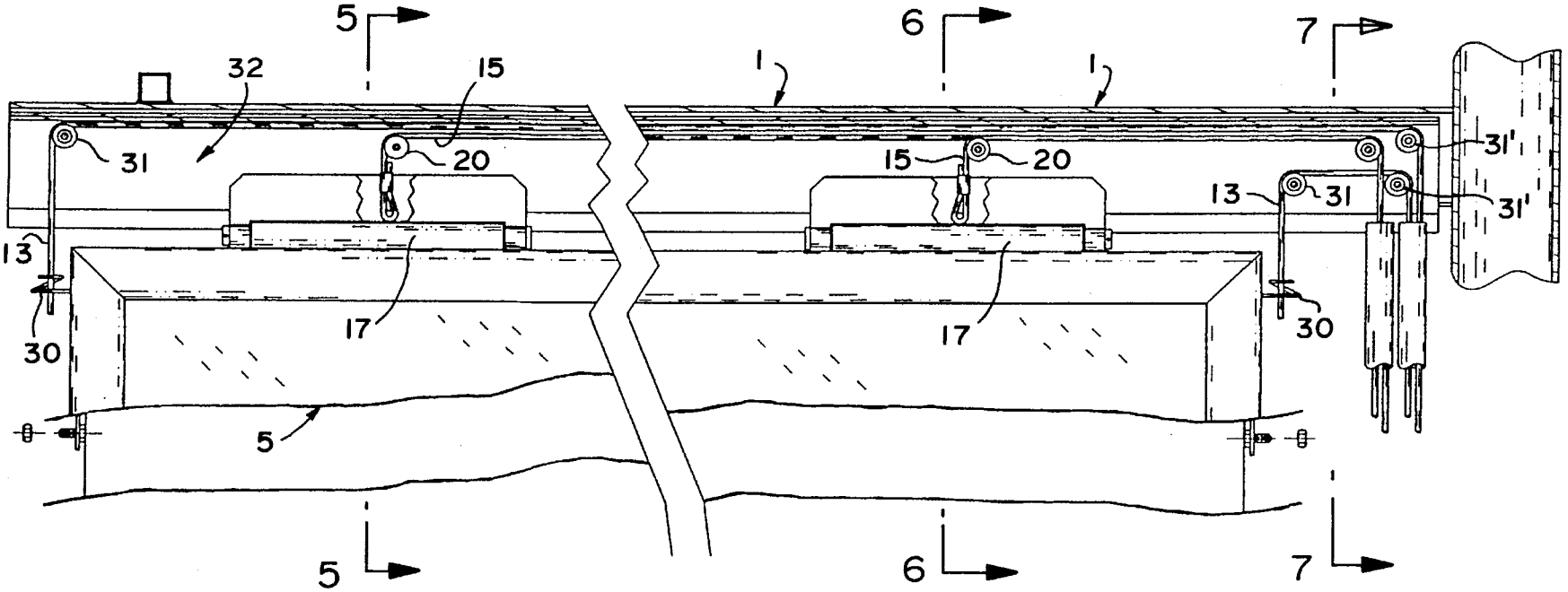
FIG. 4 is a cross-section view of the sail sign support structure taken along line 4—4 of FIG. 3 and a partial view of the sail sign exposing the sail sign's support cable attachments. Support cable and guide line pulley arrangements are also shown.
Figure 9:
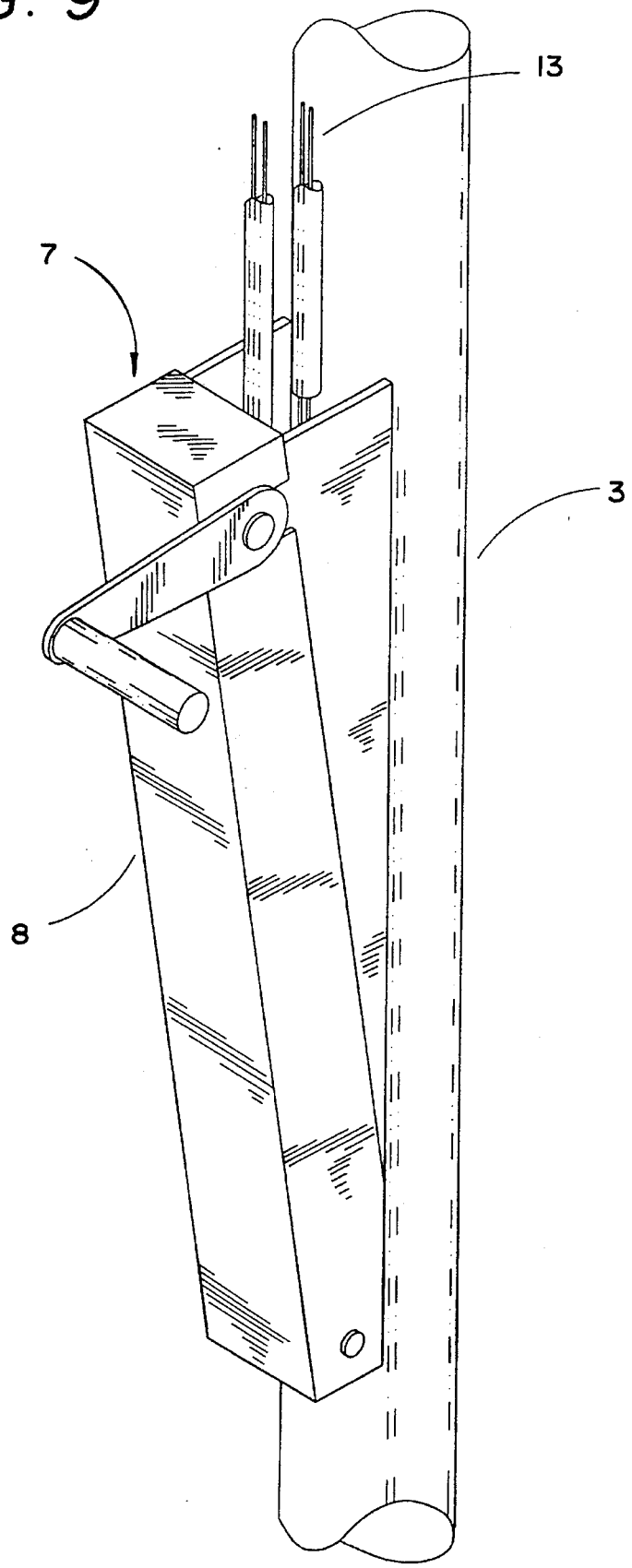
FIG. 9 is an isometric view of the winch assembly shown mounted on a sign column.
Figure 10:
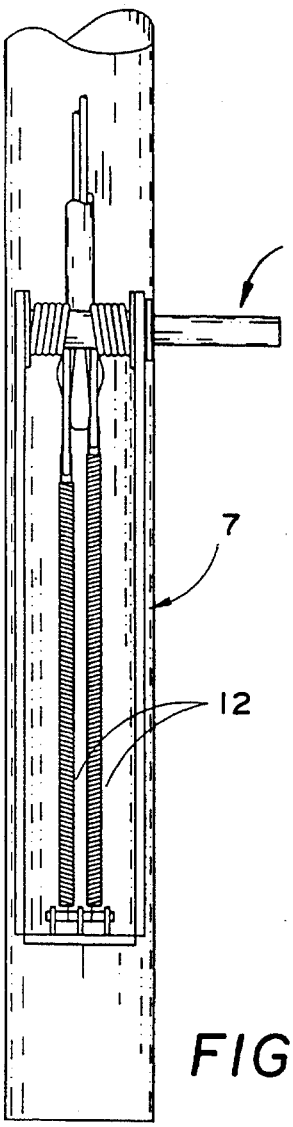
FIG. 10 is a front view of the winch assembly with cover removed for clarity.
Figure 11:
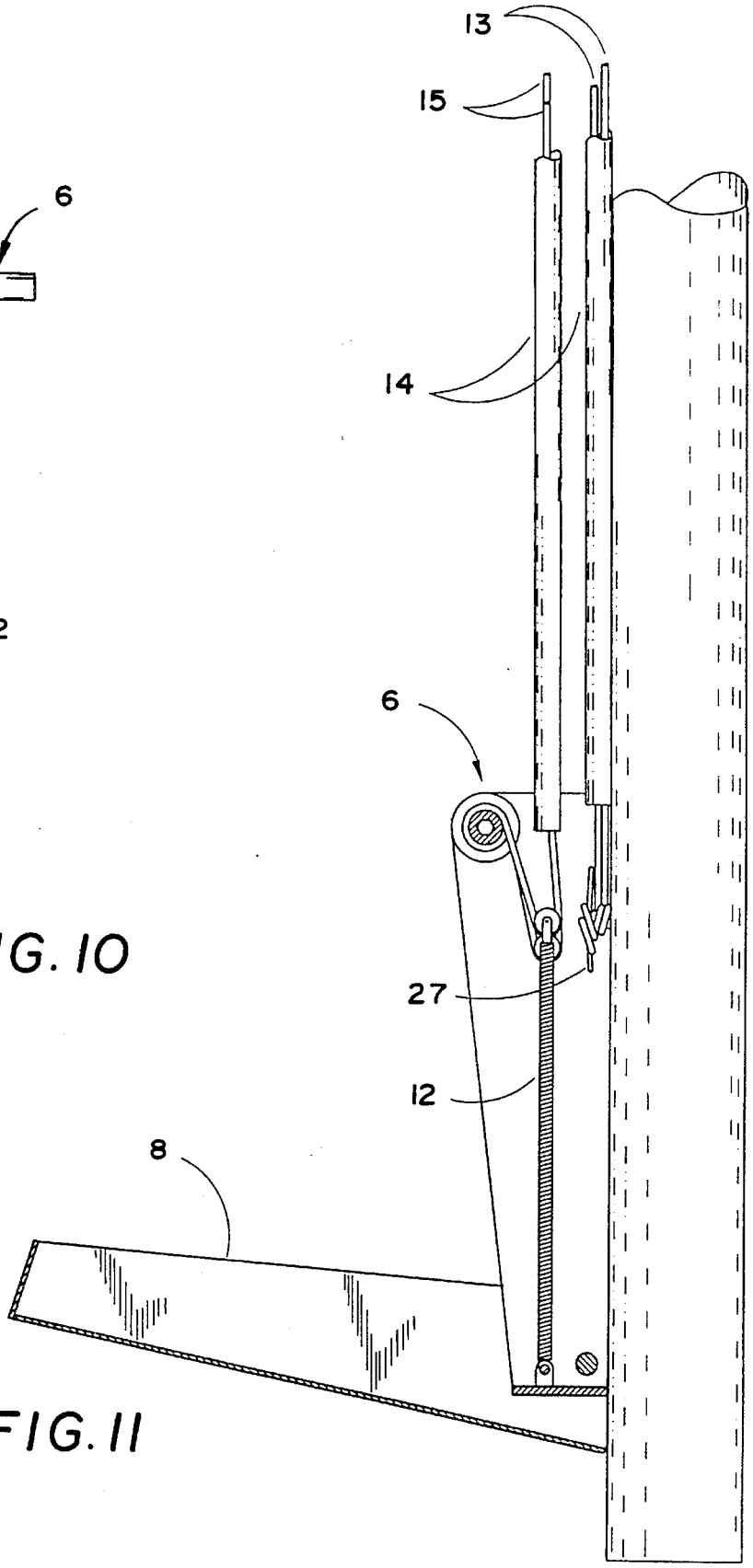
FIG. 11 is a cross-section view of the winch assembly with cover open showing cable tensioning means.

FIG. 4 provides an understanding of the support cables 15, guide lines 13, and guide system which preferably includes a channel located inside the structural support 1. The wind sail sign 5 is supported by support cables 15 attached to a pair of hinge assemblies 17 via pulleys 20 and 20' held in tension by the winch 6 and spring arrangement 12. Sufficient cable length is secured on the winch 6 drum to allow the wind sail sign 5 to be lowered to ground level. The guide lines 13 pass through a set of ring guides 30 along each side of the wind sail sign 5 and have weights 16 attached at the end. The free ends of the guide lines 13 are secured to a cleat 27 located inside the winch assembly 7 (FIGS. 9–11). Sufficient length of control guide line 13 is provided to allow the weights 16 to reach ground level when released. Each guide line 13 extends over a pair of spaced pulleys 31 and 31'. Pulleys 20 and 20' and 31 and 31' are mounted within the channel 32 which is secured within the support structure by fasteners 18 which are located outside of the support structure to allow for easy removal and maintenance. The channel 32 extends through a slot 33 in the bottom surface of the support structure.

Figure 5:
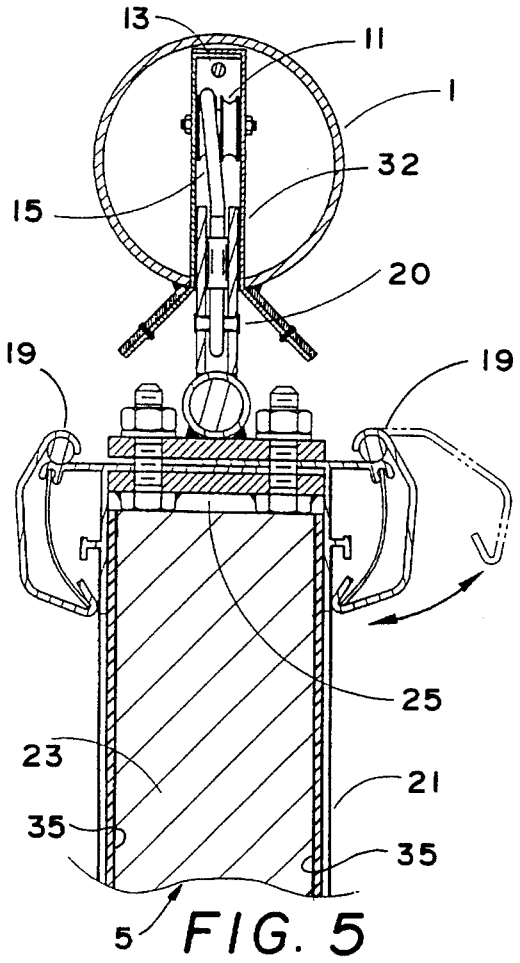
FIG. 5 is a partial cross-section view of the sail sign and sail sign support structure taken along line 5—5 of FIG. 4.
Figure 6:
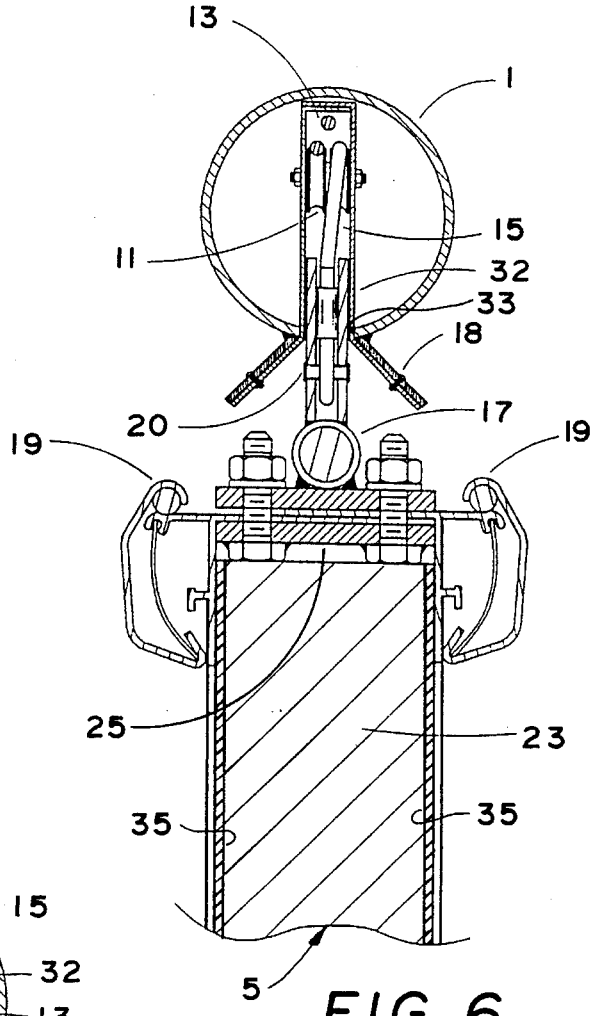
FIG. 6 is a partial cross-section view of the sail sign and sail sign support structure taken along line 6—6 of FIG. 4.
Figure 7:
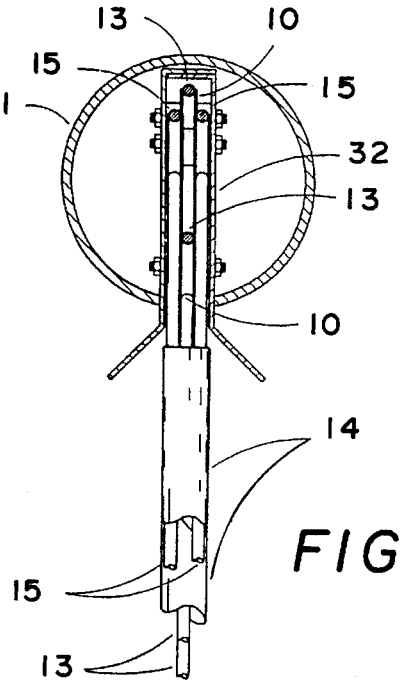
FIG. 7 is a cross-section view of the sail sign support structure taken along line 7—7 of FIG. 4.
Figure 8:
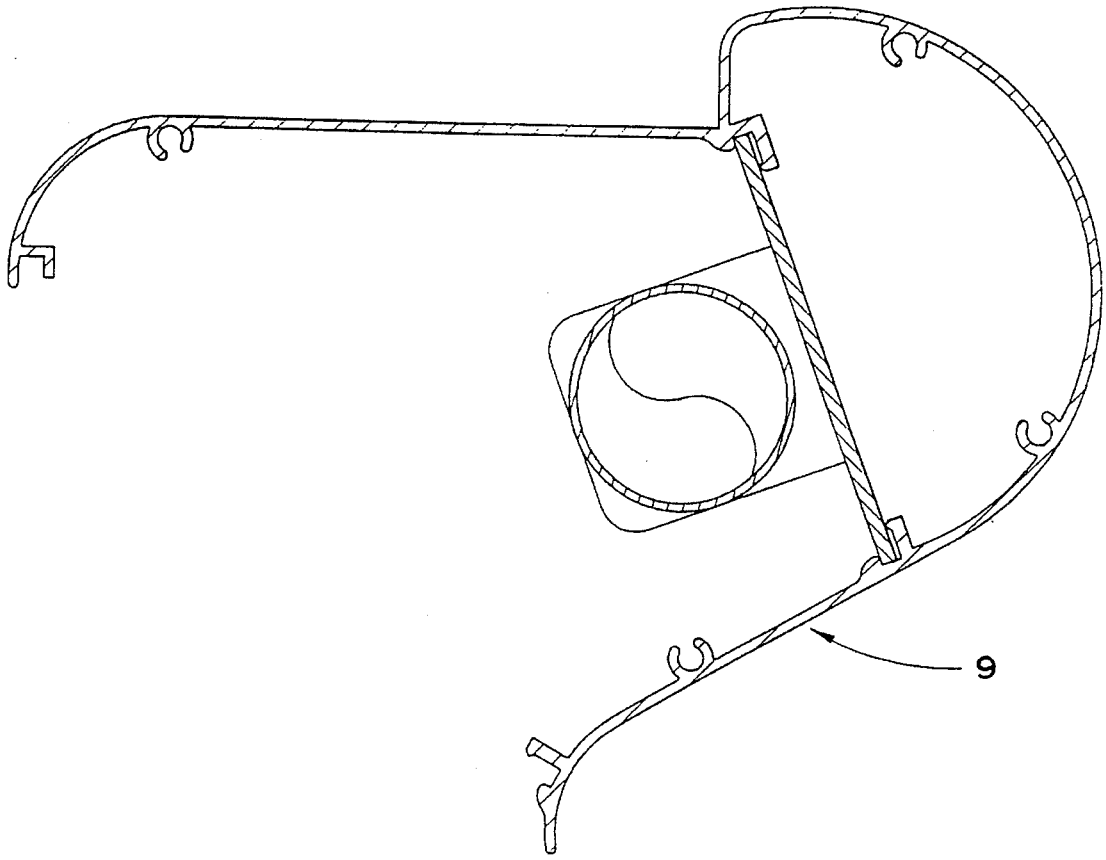
FIG. 8 is a cross-section view of the lighting fixture taken along line 8—8 of FIG. 3.

As shown in cross-section in FIG. 5 & 6 the wind sail sign 5 is comprised of two display tension frame assembles 19 surrounding a foam core 23. The foam core is weather sealed by aluminum foil 35 on each face. A laminated display paper 21 is held firmly in place by tension frame assemblies 19. Hinge assemblies 17 are attached to re-enforcing plates 25 bent at 90 degrees and located adjacent the foam core 23 at each corner of the wind sail sign 5 and further serve to secure the opposing display tension frames 19 in a box-like manner around the perimeter of the foam core 23. Conduits 14 serve as guides for support cables 15 and control guide lines 13 and further provide protection from the elements and vandalism.

The winch assembly 7 as shown in FIG. 9,10 & 11 comprises a housing having a lockable and pivotal front cover 8, a winch assembly 6 with a removable handle, which can be motor driven by a power wrench if desired, a clearing arrangement 27 for securing the control guide lines 13, and a biasing means 12 for maintaining even tension on the support cables 15.

Figure 12:
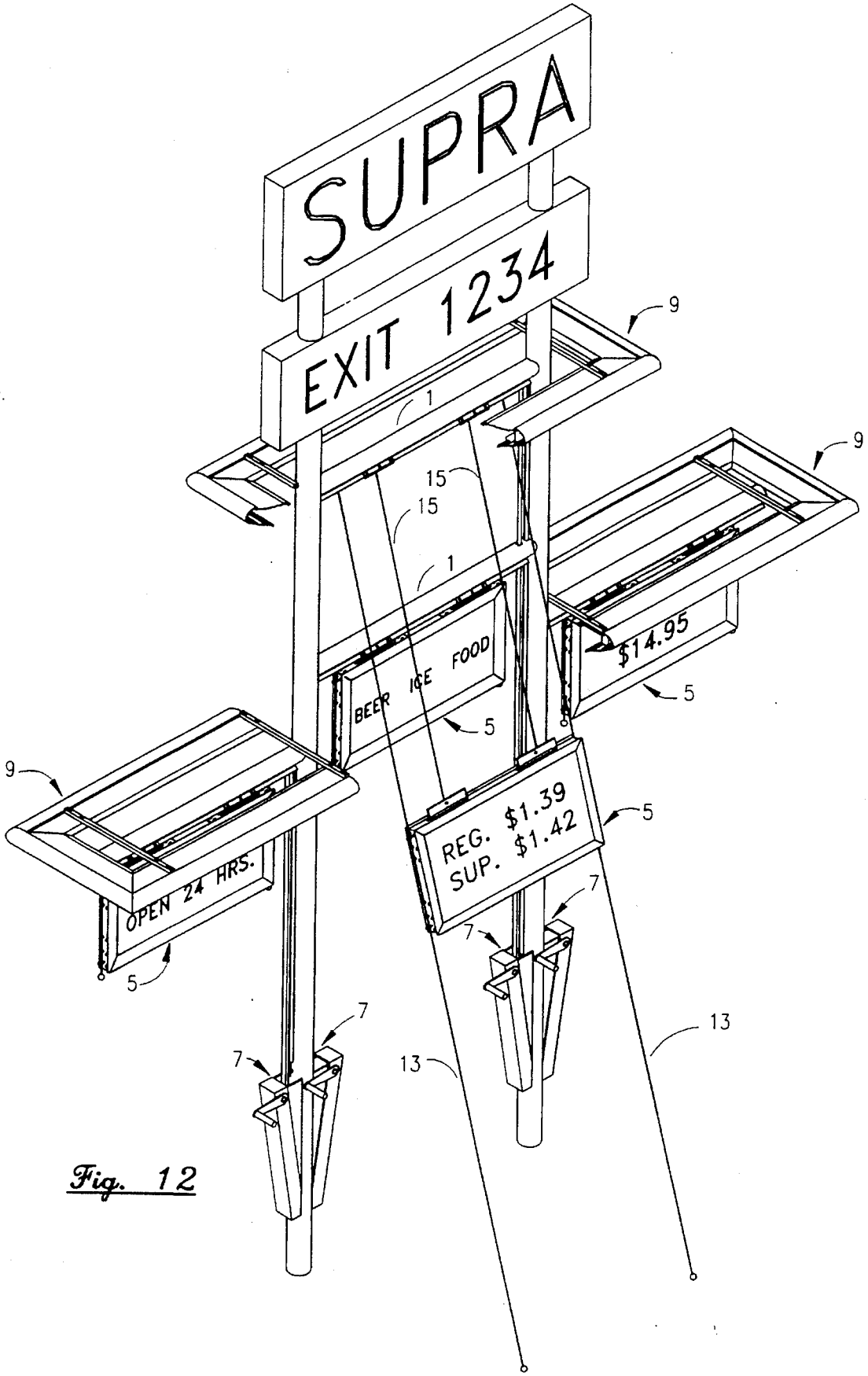
FIG. 12 is an isometric view of adaptations of the present invention to a dual column roadside sign structure showing a method of guiding a wind sail sign to or from ground level with guide lines.

When lowering the wind sail sign 5 for any reason, the guide lines 13 are released, allowing the weighted ends 16 to drop to ground level where one or two people can control the swinging motion of the wind sail sign 5. Another person can release the winch and slowly begin lowering the wind sail sign 5 while those guiding the wind sail sign 5 via the control guide lines 13 maintain control even when the wind sail sign 5 is being passed over another sign as shown in FIG. 12.

An alternative method of raising or lowering the wind sail sign 5 is anticipated by providing ground anchoring eyes, (not shown), located at an appropriate distance and angle, to provide clearance for the sign around other obstructions. One person could thread the ends of the guide lines through the anchor eye and thereby provide control and guidance of the wind sail sign while operating the winch 7.

What is claimed is:

1. A wind sail sign system for mounting to a sign column having a base portion, the system comprising;

a) a sign support member for mounting to a sign column in spaced b) guide means supported by said sign support member;

c) support cables guided by said guide means;

d) a wind sail sign attached to one end of said support cables said wind sail sign including a visual display member;

e) a winching means connected to an opposite end of said support cables;

f) a pair of guide lines guided by said guide means g) means mounted to said wind sail sign for vertically adjusting guiding said guide lines relative to said wind sail sign; and h) means for connecting said winch means to the base portion of a sign column.

2. The wind sail sign system as in claim 1 wherein said support member is a tubular member having a slot along extending along a mounted within said tubular member.

3. The wind sail sign system as in claim 2 wherein said guide lines include first ends moveable relative to said wind sail sign, and weights secured to said first ends,

4. The wind sail sign system as in claim 2 wherein said guide means includes a channel member having a plurality of pulleys mounted therein for guiding and supporting said support cables and guide lines within said channel member.

5. The wind sail sign system as in claim 4 wherein said wind sail sign is pivotally connected to said support cables by hinge means.

6. The wind sail sign system as in claim 4 wherein said means for mounting said winch means further comprises;

a) a housing having a cover; and b) biasing means located in said housing and engageable with said support cables to place tension on said support cables.

7. The wind sail sign of claim 6 wherein said wind sail sign includes;

a) a pair of opposing display tensioning frames; and b) a foam core having opposing faces and a seal on each face,

8. A wind sail sign system for mounting to existing sign columns having a base portion comprising;

a) a structural support member for attaching to an existing sign column;

b) a guide channel means attached to said structural support member;

c) support cables extending through said guide channel means;

d) a wind sail sign having a visual display member, said wind sail sign being attached to one end of said support cables, said wind sail sign having opposite sides, and a pair of guides extending from each of said opposite sides;

e) a winch means, connected to an opposite end of said support cables for raising and lowering said wind sail sign;

f) a pair of guide lines having a first end extending through said guide channel means and said guides at each side of said wind sail sign; and g) a weight secured to each of said first ends of said

9. The wind said sign system as in claim 8 wherein said structural support member is a tubular member having a slot therein.

10. The wind sail sign system as in claim 9 wherein said guide channel means extends through said slot in said structural support member.

11. The wind sail sign system as in claim 10 wherein said guide channel means includes a plurality of pulleys for supporting and guiding said cables and guide lines.

12. The wind said sign system as in claim 11 wherein said wind sail sign is pivotally connected to said support cables by hinge means.

13. The wind sail sign system of claim 11 wherein said winch means includes a biasing means for maintaining equal tension on said support cables.

14. A wind sail sign system comprising:

a) a vertically extending sign column having a base portion;

b) a sign support member mounted to said sign column in spaced relationship to said base portion;

c) a wind sail sign;

d) a winch means mounted to said base portion of said sign column;

e) support cable means having one end connected to said wind sail sign and another end connected to said winch means;

f) guide means carried by said sign support members;

guide line means extending from a first end adjacent said wind sail sign and a second end adjacent said base portion of said sign column;

h) each of said support cable means and guide line means being guided by said guide means towards said wind sail sign; and i) means extending from said wind sail sign for guiding said guide line means in vertically movable relationship with respect to said wind sail sign.

15. The wind sail sign system of claim 14 in which said winch means includes a housing which is movable with respect to said base portion of said sign column, and biasing means for placing tension on said support cables mounted within said housing.

16. The wind sail sign system of claim 14 in which said guide means includes a channel member mounted at least partially within said sign support member, and a plurality of first and second spaced pulleys for guiding said support cable means and said guide lines mounted within said channel member.

17. The wind sail sign system of claim 16 including weights secured to said first end of said guide line means.

* * * * *